US007563019B2

(12) United States Patent
Buchholz

(10) Patent No.: US 7,563,019 B2
(45) Date of Patent: Jul. 21, 2009

(54) DISPERSING DEVICE

(75) Inventor: Marko Buchholz, Marklohe (DE)

(73) Assignee: EKATO Process Technologies GmbH, Freiburg (DE)

( * ) Notice: Subject to any disclaimer, the term of this patent is extended or adjusted under 35 U.S.C. 154(b) by 604 days.

(21) Appl. No.: 11/263,574

(22) Filed: Oct. 31, 2005

(65) Prior Publication Data

US 2006/0109738 A1 May 25, 2006

Related U.S. Application Data

(63) Continuation of application No. PCT/EP2004/004741, filed on May 4, 2004.

(30) Foreign Application Priority Data

May 5, 2003 (DE) ..... 203 06 915 U

(51) Int. Cl.
*B01F 5/04* (2006.01)

(52) U.S. Cl. ..... 366/162.4; 137/597

(58) Field of Classification Search ..... 366/162.4, 366/162.5, 173.1, 173.2; 137/597
See application file for complete search history.

(56) References Cited

U.S. PATENT DOCUMENTS 949,869 A * 2/1910 White ..... 137/630.17
1,522,120 A * 1/1925 Halder ..... 137/597
2,025,479 A * 12/1935 Spear et al. ..... 137/512
3,053,276 A * 9/1962 Woodward ..... 137/597
3,183,065 A * 5/1965 De Bolt ..... 422/231
3,823,408 A * 7/1974 Gordon, III ..... 347/47
3,917,756 A * 11/1975 Rice ..... 261/18.1
4,506,987 A 3/1985 Daughton et al.
4,566,628 A * 1/1986 Latarius ..... 237/8 C
5,932,100 A * 8/1999 Yager et al. ..... 210/634

(Continued)

FOREIGN PATENT DOCUMENTS

DE 101 41 054 A 3/2003

(Continued)

OTHER PUBLICATIONS

Jacobson S. C. et al.: "Microfluidic Devices for Electrokinetically Driven Parallel and Serial Mixing", Analytical Chem, AM Chem SOC Columbus, US, vol. 71, No. 20, Oct. 15, 1999, pp. 4455-4459, XP000854089 ISSN: 0003-2700.

(Continued)

*Primary Examiner*—David L Sorkin
(74) *Attorney, Agent, or Firm*—Henry M. Feiereisen; Ursula B. Day

(57) ABSTRACT

A dispersing device for dispersing, homogenizing and mixing fluidic multi-component systems and for dispersing, homogenizing, mixing and micronizing solids includes a nozzle body, two inlet nozzle assemblies and two outlet nozzle assemblies which are received in the nozzle body. These nozzle assemblies are connected to a central inner space of the nozzle body via corresponding bores. The inner space can have a circular, quadratic, rectangular or elliptical cross-section. The inlet nozzle assemblies and the outlet nozzle assemblies are provided in pairs, whereby at least one pair of inlet nozzle assemblies and one pair of outlet nozzle assemblies are provided, although an odd number of inlet nozzle assemblies and outlet nozzle assemblies can also be provided, e.g. 3, 5 or 7.

24 Claims, 5 Drawing Sheets

U.S. PATENT DOCUMENTS 6,730,214 B2 * 5/2004 Mazzei ..... 210/188

FOREIGN PATENT DOCUMENTS

| | | | |
|---|---|---|---|
| FR | 2 014 450 | A | 4/1970 |
| GB | 1 060 540 | A | 3/1967 |
| JP | 56 058530 | A | 5/1981 |
| WO | WO 98/00228 | A | 1/1998 |
| WO | WO 01/28670 | A | 4/2001 |
| WO | WO 01/51918 | A | 7/2001 |

OTHER PUBLICATIONS

Ukita H et al.: "A Shuttlecock Optical Rotator-Its Design, Fabrication and Evaluation for a Microfluidic Mixer", IEEE Journal on Selected Topics in Quantum Electronics, IEEE Service Center, US, vol. 8, No. 1, Jan. 2002, pp. 111-117, XP001116253; ISSN: 1077-260X.

* cited by examiner

DISPERSING DEVICE

CROSS-REFERENCES TO RELATED APPLICATIONS

This application is a continuation of prior filed copending PCT International application no. PCT/EP2004/004741, filed May 4, 2004, which designated the United States and on which priority is claimed under 35 U.S.C. §120, and which claims the priority of German Patent Application, Ser. No. 203 06 915.3, filed May 5, 2003, pursuant to 35 U.S.C. 119(a)-(d), the subject matter of which is/are incorporated herein by reference.

BACKGROUND OF THE INVENTION

The present invention relates to a dispersing device, in particular for dispersing, homogenizing and mixing fluidic multi-component systems as well as for dispersing, homogenizing, mixing and micronizing of solids. Dispersing devices of this type are typically used in conjunction with high pressure homogenizers.

It would be desirable and advantageous to provide an improved dispersing device to obviate prior art shortcomings and to provide an effective dispersing, homogenizing, mixing and micronizing.

SUMMARY OF THE INVENTION

According to one aspect of the present invention, a dispersing device, in particular for dispersing, homogenizing and mixing fluidic multi-component systems as well as for dispersing, homogenizing, mixing and micronizing of solids, includes a nozzle body having an inner space, at least two inlet nozzle assemblies received in the nozzle body and communicating with the inner space, and at least two outlet nozzle assemblies received in the nozzle body and communicating with the inner space.

The present invention resolves prior art problems by providing the dispersing device with at least a pair of inlet nozzle assemblies and a pair of outlet nozzle assemblies.

According to another feature of the present invention, the outlet nozzle assemblies have a flow cross section which is greater than a through flow cross section of the inlet nozzle assemblies.

According to another feature of the present invention, the inlet and outlet nozzle assemblies may each have a nozzle of round, elliptic or rectangular cross section. The nozzle may hereby have a bore of circular, elliptic or rectangular cross section.

According to another feature of the present invention, the nozzle of the inlet nozzle assemblies may have a diameter or slot width of about 0.1 to 5.0 mm. Currently preferred is a diameter or slot width of about 0.2 to 0.6 mm.

According to another feature of the present invention, the nozzle of the outlet nozzle assemblies may have a diameter or slot width of about 0.1 to 10.0 mm. Currently preferred is a diameter or slot width of 0.2 to 2 mm.

According to another feature of the present invention, the inlet nozzle assemblies and the outlet nozzle assemblies can be arranged respectively at an angle ranging from about 10° to 350° relative to one another. Suitably, the inlet nozzle assemblies and the outlet nozzle assemblies may be arranged respectively at an angle ranging from about 45° to 315° relative to one another. Currently preferred is an arrangement of the inlet nozzle assemblies at an angle of 180°, and an arrangement of the outlet nozzle assemblies at an angle of 180°.

According to another feature of the present invention, the inner space of the nozzle body may have a circular, rectangular or elliptic cross section.

According to another feature of the present invention, the inlet nozzle assemblies and the outlet nozzle assemblies may each have a nozzle holder for receiving the nozzle. The nozzle holder may hereby have a conical inlet and/or a conical outlet.

According to another feature of the present invention, the inlet nozzle assemblies may be positioned at a parallel offset relationship.

According to another feature of the present invention, at least one of the inlet nozzle assemblies can be swingably mounted in the nozzle body in relation to a longitudinal center axis of the nozzle body such that the center axis of the respective inlet nozzle assemblies extends eccentrically to the center point of the dispersing device. Suitably, the at least one of the inlet nozzle assemblies may be swingably mounted for movement about an angle of 0° to +/−80° in relation to the longitudinal center axis.

According to another feature of the present invention, the nozzle may be made of wear-resistant material. Examples of wear-resistant material include sapphire, diamond, silicon carbide, or ceramics.

According to another feature of the present invention, an odd number of inlet nozzle assemblies and outlet nozzle assemblies may be provided, such as, e.g., three, five or seven.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
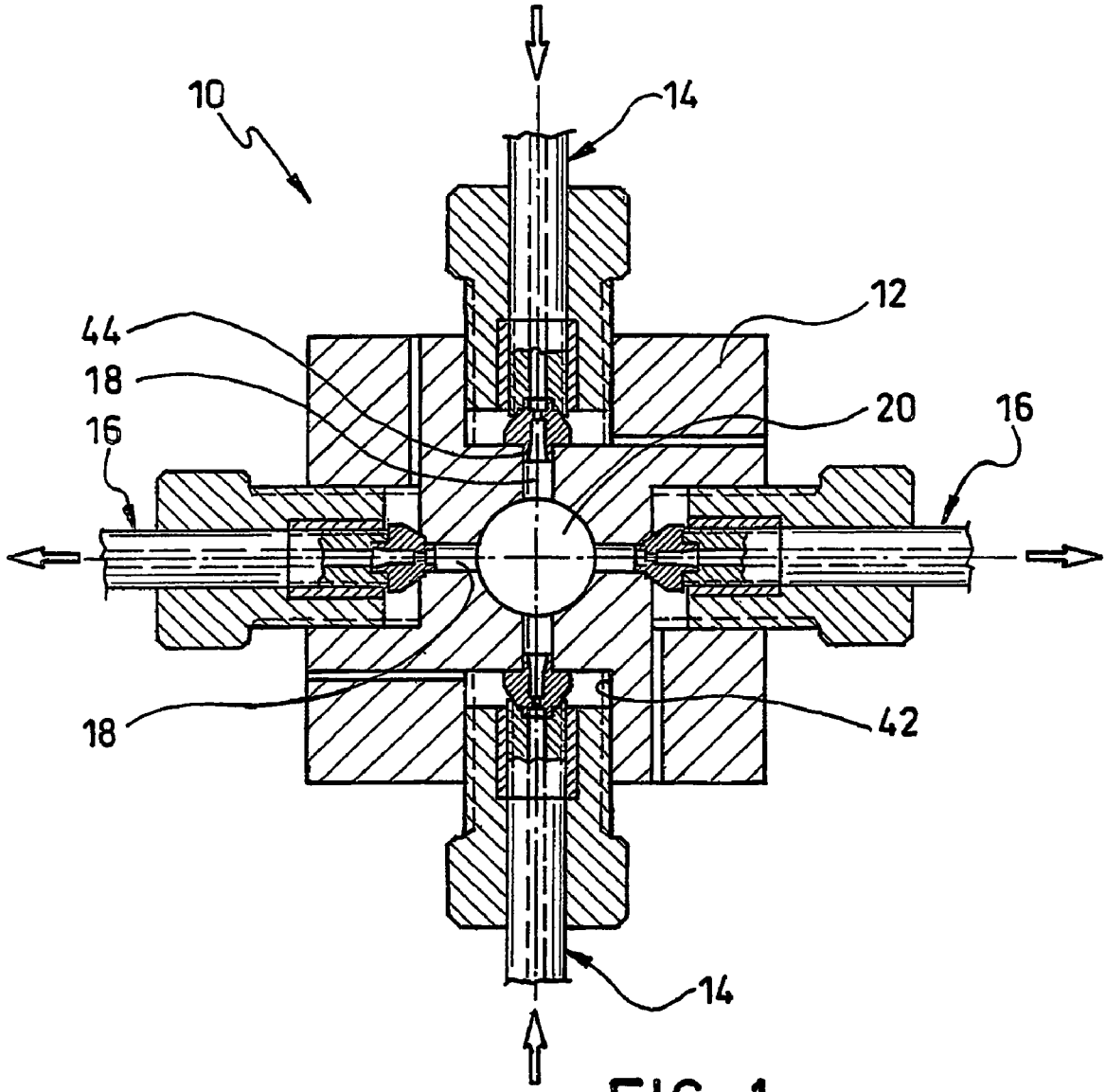
FIG. 1 is a cross sectional view of one embodiment of a dispersing device according to the invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 3:
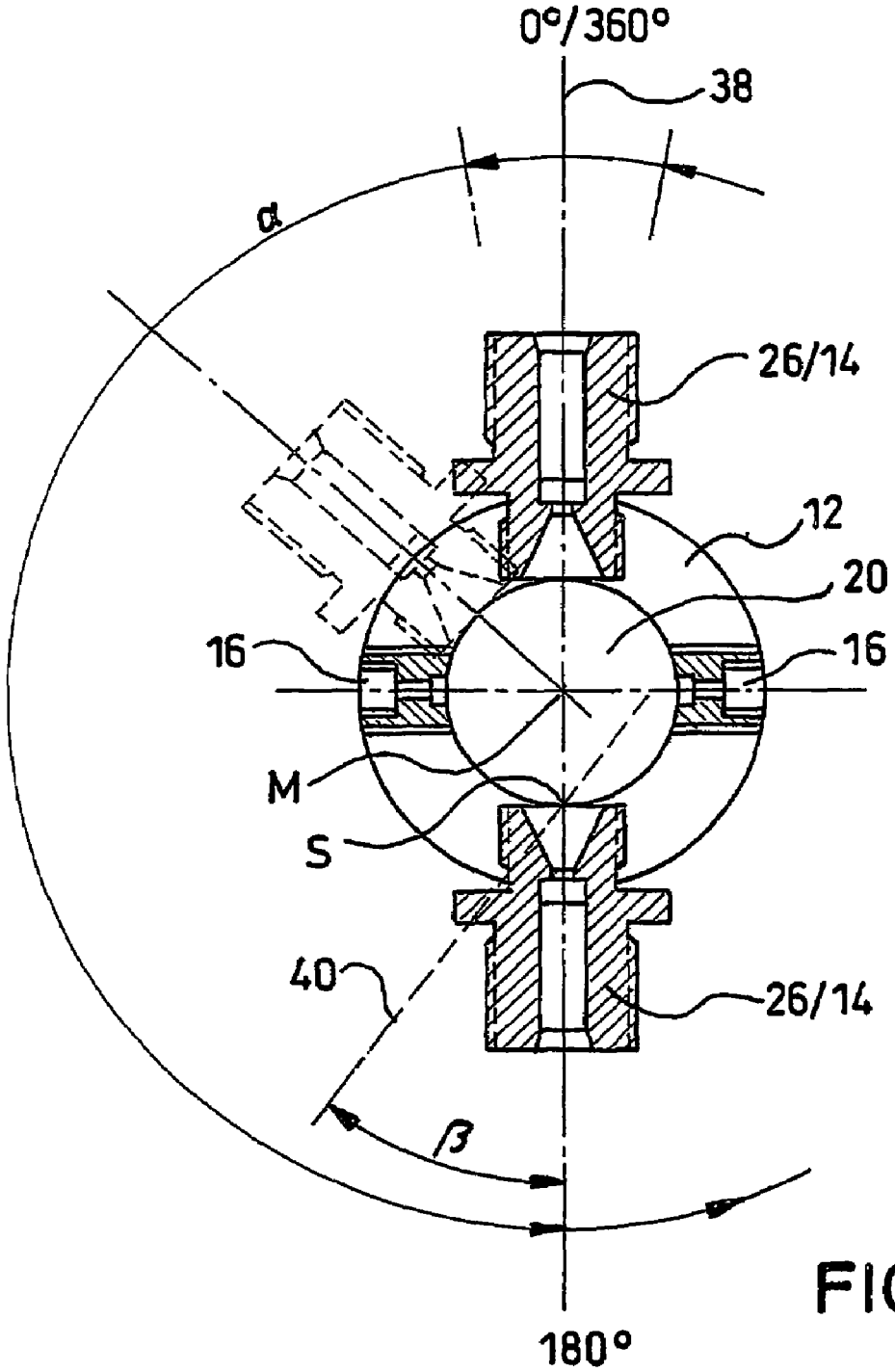
FIG. 3 is a schematic sectional view of another embodiment of a dispersing device according to the invention with adjustable arrangement of an nozzle assembly.

Turning now to the drawing, and in particular to FIG. 1, there is shown a cross sectional view of one embodiment of a dispersing device according to the invention, generally designated by reference numeral 10. The dispersing device 10 includes a nozzle body 12 made, e.g., of special steel and having a square or rectangular cross section. The cross section may also be circular, as illustrated in FIG. 3. Received in the nozzle body 12 of the dispersing device 10 are two inlet nozzle assemblies, generally designated by reference numeral 14, and two outlet nozzle assemblies, generally designated by reference numeral 16. The nozzle assemblies 14, 16 communicate with a central inner space 20 of the nozzle body 12 via respective bores 18. The inner space 20 can have a circular, square, rectangular or elliptic cross section. The inlet nozzle assemblies 14 and the outlet nozzle assemblies 16 are each constructed in pairs, with at least one pair of inlet nozzle assemblies 14 and one pair of outlet nozzle assemblies 16 being provided. Of course, also an odd number of inlet nozzle assemblies and outlet nozzle assemblies may be provided, e.g. 3, 5, or 7.

Figure 4A:
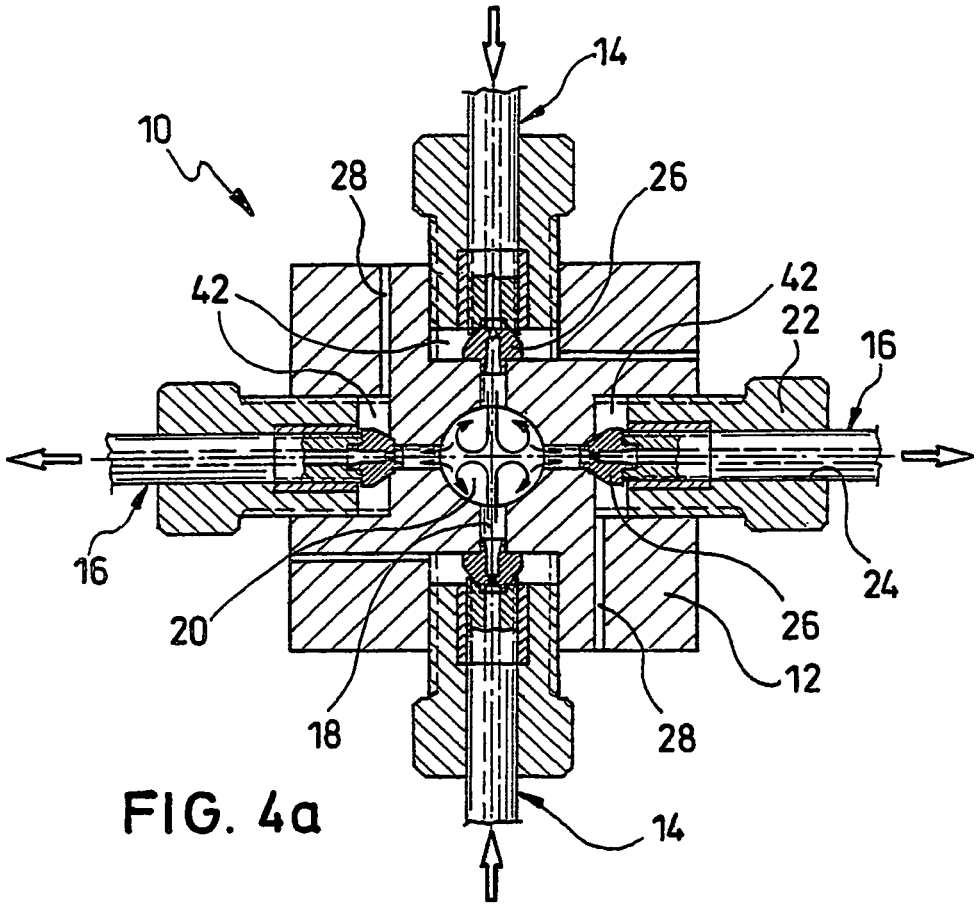
FIGS. 4*a* and 4*b* show examples for a flow pattern in an inner space in a nozzle body of a dispersing device according to the invention.

As shown in particular in FIG. 4*a*, each of the inlet nozzle assemblies 14 and outlet nozzle assemblies 16 includes a nozzle head 22 which is provided with an outer thread and is threadably engaged in a threaded bore 42 formed in the nozzle body 12. Each nozzle head 22 is provided with a longitudinal bore 24 for supply and discharge of materials to be treated. Disposed between an inner end of each nozzle head 22 and the pertaining bore 18, which leads to the inner space 20, is a nozzle holder 26, whereby the nozzle holder 26 of the outlet nozzle assemblies 16 is connected to the associated nozzle head 22 via respective threads, whereas the nozzle holder 26 of the inlet nozzle assemblies 14 is inserted in the respective bore 18 by means of a short cylindrical collar, as will be described in more detail with reference to FIG. 2. Suitably, each of the threaded bores 42 of the nozzle body 12 is provided with a pressure relief bore 28, as shown in FIG. 4*a*.

Figure 2:
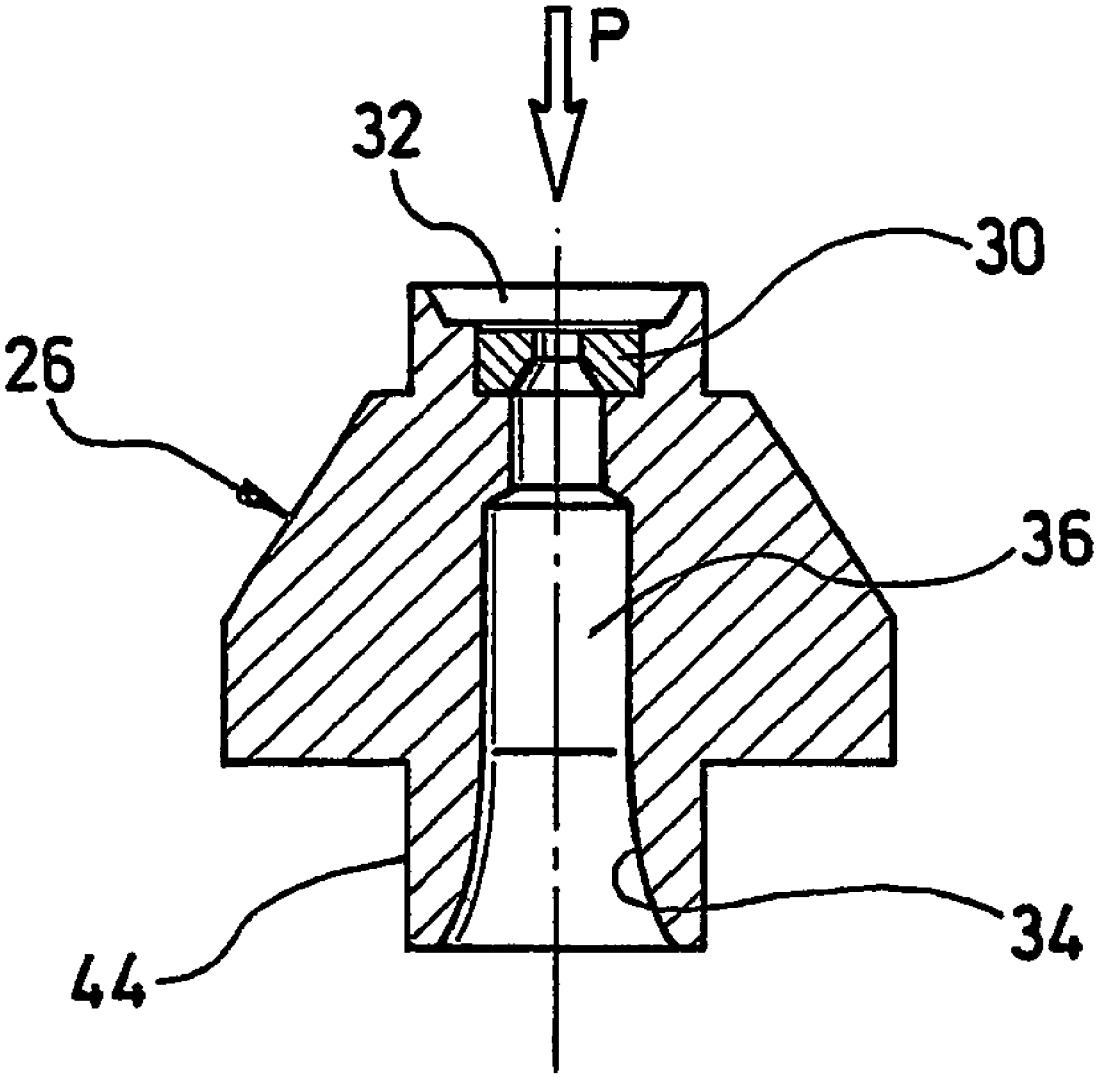
FIG. 2 is a sectional view of a nozzle received in a nozzle holder.

FIG. 2 shows schematically a section of the nozzle holder 26 having a pocket for receiving a nozzle 30. The flow direction through the nozzle 30 is the same for the inlet nozzle assemblies 14 as for the outlet nozzle assemblies 16 and indicated in FIG. 2 by arrow P. The nozzle holder 26 is provided with an inlet 32 to the nozzle 30 and an outlet 34 from the nozzle 30 as well as a longitudinal bore 36 extending through the entire nozzle holder 26.

The cross section of the inlet 32 and the cross section of the outlet 34 are, preferably, designed conically, but may also be cylindrically. The conical configuration of inlet 32 and outlet 34 is currently preferred because it results in a reduction in flow loss in the inlet and outlet of the nozzle assemblies 14, 16. Moreover, the conical outlet 34 causes at the inlet nozzle assemblies 14 a forced widening of the fluid jet, so as to have a positive effect on the generation of turbulence in the nozzle body 12.

The nozzle 30 of each nozzle 26 of the nozzle assemblies 14, 16 may have a circular, slotted or rectangular cross section, whereby the nozzle 30 of the inlet nozzle assemblies 14 has a diameter or slot width ranging from about 0.1 to 5 mm, suitably from 0.2 to 0.6 mm. When the nozzle 30 is slotted or rectangular, the afore-stated size specifications relate to the smaller value, i.e. to the slot width or slot height. The length of the slotted or rectangular nozzle 30 may range from 1 to about 50 mm.

With respect to the outlet nozzle assemblies 16, the diameter or slot width of the nozzle 30 ranges from about 0.1 to 10.0 mm. Currently preferred is a range from about 0.2 to 2 mm. Also here, when slotted or rectangular nozzles 30 are involved, these size specifications relate to the smaller value, i.e. to the slot width or slot height. The length of the slotted or rectangular nozzle ranges, for example, from 1 to about 50 mm.

The diameter or slot width or in general the cross section of the nozzle 30 is greater for the outlet nozzle assemblies 16 than for the inlet nozzle assemblies 14. The diameter or slot width of the outlet nozzle assemblies 16 is hereby selected such that about 1 up to less than 50% of the total pressure drop takes place across the exit of the medium from the dispersing device.

As shown in FIG. 2, the nozzle holder 26 has one end which faces away from the nozzle 30 and includes a cylindrical collar 44 which, as shown in FIGS. 1 and 4, is inserted in the bores 18 for the inlet nozzle assemblies 14, while received in the nozzle head 22 for the outlet nozzle assemblies 16.

The nozzle 30 is made of wear-resistant material, like, for example, sapphire, diamond, silicon carbide or ceramics or also similar materials.

The nozzle body 12 can have a square cross section, as shown by way of example in the embodiment of FIG. 1, or can have a circular cross section, like in the embodiment of FIG. 3.

In the embodiment of FIG. 3, the inlet nozzle assemblies 14 and the outlet nozzle assemblies 16 are arranged in the nozzle body 12 about a circle. FIG. 3 shows the nozzle body 12 only schematically, and the nozzle holder 26 of the inlet nozzle assemblies 14 is illustrated only for the sake of simplicity. The angle $\alpha$ between the center axes of both inlet nozzle assemblies 14 may range from about 10° to 350°, suitably from about 45° to 315°. Currently preferred is an angle $\alpha$ of 180°. Also the respective angle between the center axes of both outlet nozzle assemblies 16 may range from about 10° to 350°, suitably from about 45° to 315°, whereby an angle $\alpha$ of 180° is currently preferred. At an angle of $\alpha$=180° between both inlet nozzle assemblies 14, incoming fluid jets impact directly upon one another. As a consequence, the momentum of the jets very quickly offset one another, whereby the time interval for offsetting the momentum of the impinging fluid jets is predominantly dependent on the flow rate which, in turn, is in close correlation with the pressure drop and the material properties of the substances to be treated. As already mentioned above, the dimensions of the nozzles 30 are so selected that less than 50% of the total pressure drop takes place in the outlet nozzles. Thus, the size and location of cavitation phenomena can be controlled. The total pressure drop across the nozzle system is above 10 bar and preferably above 100 bar.

In the embodiment according to FIG. 3, but also in the embodiments according to FIGS. 1 and 4, the angle $\alpha$ between both inlet nozzle assemblies 14 is 180°, and the respective angle between both outlet nozzle assemblies 16 is also 180°.

Figure 5:
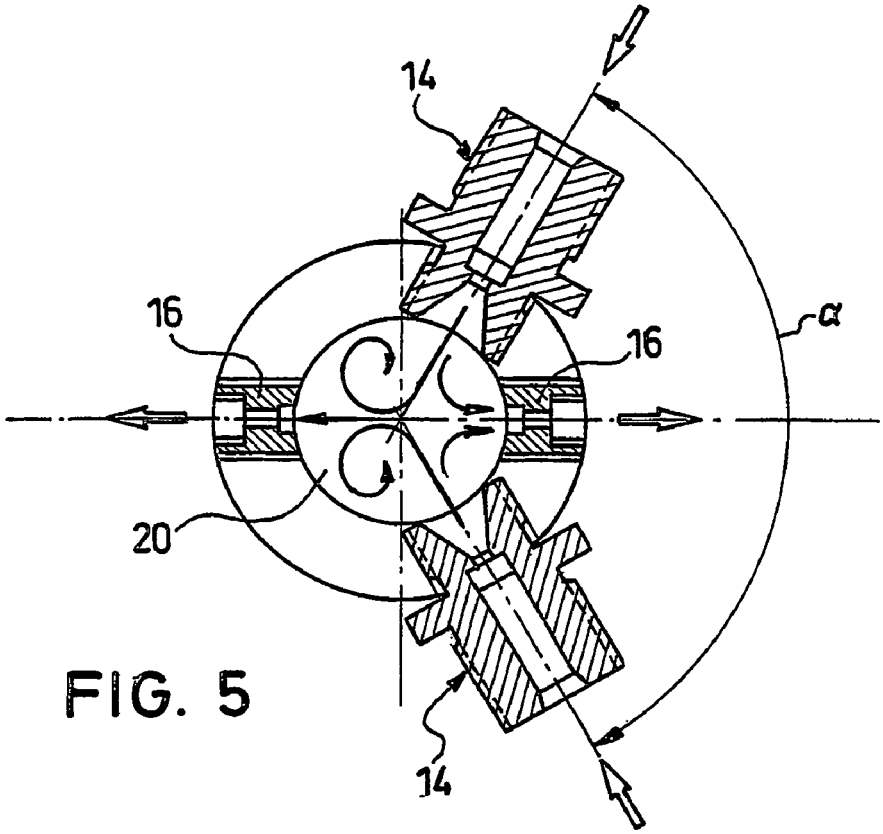
FIG. 5 is a schematic sectional view of a dispersing device according to the invention, depicting a variation of placement of inlet nozzle assemblies in the nozzle body.

FIG. 5 shows, however, an embodiment of a dispersing device in which the angle $\alpha$ between both outlet nozzle assemblies 16 is 180°, whereas the angle $\alpha$ between both inlet nozzle assemblies 14 is less than 180°. At this flow conduction, involving thus fluid jets that impact one another at an angle $\alpha$ of less than 180°, the momentum of the fluid jets offset each other at a slower pace than when $\alpha$=180°. In some material systems (for example at a slower adsorption rate of the emulsifying agent), such an arrangement may be appropriate.

Figure 6:
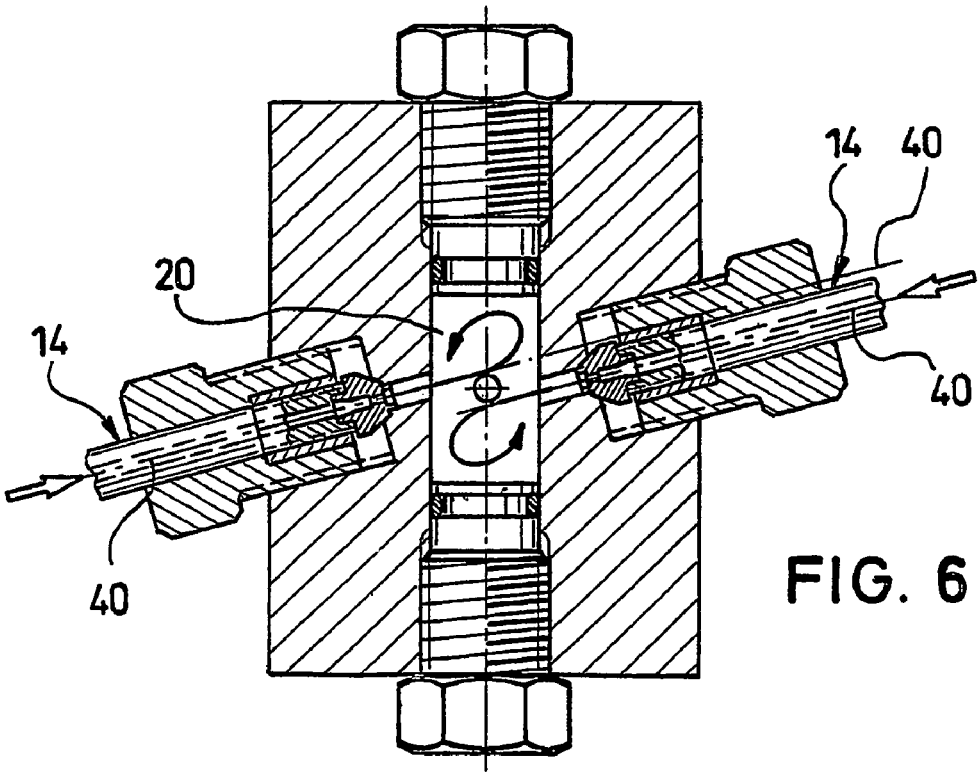
FIG. 6 is a schematic sectional view of a dispersing device according to the invention, depicting another variation of placement of inlet nozzle assemblies in the nozzle body.

In the embodiment of a dispersing device according to the invention, as shown in FIG. 6, the longitudinal center axes 40 of both inlet nozzle assemblies 14 are disposed in parallel offset relationship. As a consequence, the fluid jets flow past one another. An intimate mixing is, however, realized in the boundary area of both fluid jets whereby the extent of the mixture can be controlled in dependence on the size of the parallel offset of both inlet nozzle assemblies 14. When heterogeneous systems are involved, this may result in a targeted bimodality or multimodality in the size distribution of the dispersed phase.

Another possibility to prevent the fluid jets to directly impact one another in the area of the inlet nozzles 14 is shown schematically in FIG. 3. In this embodiment, the lower one of the shown inlet nozzle assemblies 14 can be pivoted about an angle β in relation to the longitudinal center axis 38 (or longitudinal center plane) of the nozzle body 12. The angle β may range hereby in relation to the longitudinal center axis 38 from 0° to +/−80°. Reference numeral 40 designates hereby the center axis of the pivoted inlet nozzle assembly 14. The pivot point is, however, not coincidental with the center point M of the nozzle body 12 but a point S which is defined by the point of intersection of the longitudinal center axis 38 with the wall of the inner space 20. The fluid jets exiting this swingable inlet nozzle 14 in this way are thus not directed directly upon the center point M of the nozzle body 12. Thus, also in this embodiment, the fluid jets outgoing from the inlet nozzle assemblies 14 flow past one another with the results as already described above.

Figure 4B:
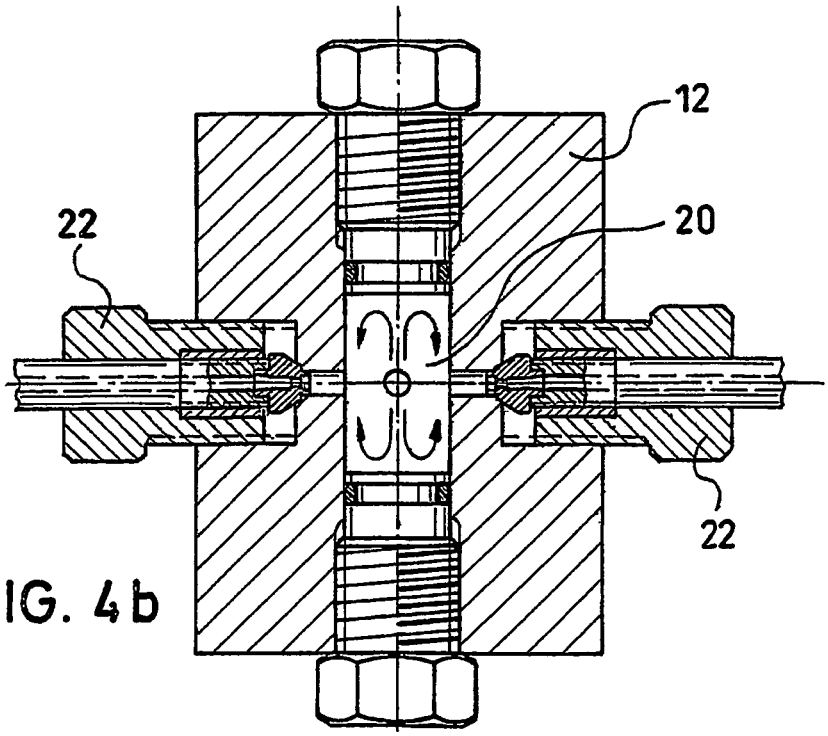

FIGS. 4*a* and 4*b* as well as FIGS. 5 and 6 show schematically flow patterns of the materials to be treated in the inner space 20 of the nozzle body 12. In FIG. 4, the outlet nozzle assemblies have been removed and replaced by screw plugs threadably engaged in the threaded bores 42 of the nozzle body 12.

The afore-described pressure drop across the outlet nozzle 30 and the thus resultant flow rate, having turbulent fluctuation motions, provides predominantly that newly formed interfaces of auxiliary emulsifying agents can be wetted and thus leads to a stabilization of the product.

The materials to be treated in the device according to the invention are preferably emulsions of at least two liquids that are essentially insoluble with one another, foams with at least a gaseous and at least a liquid component as well as suspensions having at least one solids component formulated in a fluid system.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A dispersing device, in particular for dispersing, homogenizing and mixing fluidic multi-component systems as well as for dispersing, homogenizing, mixing and micronizing of solids, comprising:

a nozzle body having an inner space;

at least two inlet nozzle assemblies received in the nozzle body, each said inlet nozzle assembly sized to end at a distance to the inner space and communicating with the inner space via a bore in the nozzle body, each said inlet nozzle assembly having opposite ends and constructed to narrow from one end to a constriction and expanding to the other end; and at least two outlet nozzle assemblies received in the nozzle body, each said outlet nozzle assembly sized to end at a distance to the inner space and communicating with the inner space via a bore in the nozzle body.

2. The device of claim 1, wherein the outlet nozzle assemblies have a flow cross section which is greater than a through flow cross section of the inlet nozzle assemblies.

3. The device of claim 1, wherein the inlet and outlet nozzle assemblies have each a nozzle of round, elliptic or rectangular cross section.

4. The device of claim 3, wherein the nozzle of the inlet nozzle assemblies has a diameter or slot width of about 0.1 to 5.0 mm.

5. The device of claim 3, wherein the nozzle of the inlet nozzle assemblies has a diameter or slot width of about 0.2 to 0.6 mm.

6. The device of claim 3, wherein the nozzle of the outlet nozzle assemblies has a diameter or slot width of about 0.1 to 10.0 mm.

7. The device of claim 6, wherein the inlet nozzle assemblies and the outlet nozzle assemblies are respectively arranged at an angle of 180°.

8. The device of claim 3, wherein the nozzle of the outlet nozzle assemblies has a diameter or slot width of about 0.2 to 2 mm.

9. The device of claim 3, wherein the inlet nozzle assemblies and the outlet nozzle assemblies have each a nozzle holder for receiving the nozzle.

10. The device of claim 9, wherein the nozzle holder has a conical inlet and a conical outlet.

11. The device of claim 9, wherein the inlet and outlet nozzle assemblies have each a nozzle head which is threadably engaged in the nozzle body, and wherein the nozzle holder of each of the inlet and outlet nozzle assemblies has a nozzle-distal end in the form of a collar, said collar of each inlet nozzle assembly being threadably engaged in a bore between the inlet nozzle assembly and the inner space of the nozzle body, and said collar of each outlet nozzle assembly being received in the nozzle head.

12. The device of claim 3, wherein the nozzle is made of wear-resistant material.

13. The device of claim 12, wherein the nozzle is made of a material selected from the group consisting of sapphire, diamond, silicon carbide, and ceramics.

14. The device of claim 3, wherein the nozzle has a bore of circular, elliptic or rectangular cross section.

15. The device of claim 3, wherein the nozzle has a length from 1 to about 50 mm.

16. The device of claim 1, wherein the inlet nozzle assemblies and the outlet nozzle assemblies are respectively arranged at an angle ranging from about 10° to 350° relative to one another.

17. The device of claim 1, wherein the inlet nozzle assemblies and the outlet nozzle assemblies are respectively arranged at an angle ranging from about 45° to 315° relative to one another.

18. The device of claim 1, wherein the inner space of the nozzle body has a circular, rectangular or elliptic cross section.

19. The device of claim 1, wherein the inlet nozzle assemblies and the outlet nozzle assemblies are disposed in the nozzle body in alternating spaced-apart relationship about the inner space so that the inlet nozzle assemblies confront one another and the outlet nozzle assemblies confront one another.

20. The device of claim 1, wherein the inlet nozzle assemblies confront one another at a parallel offset relationship.

21. The device of claim 1, wherein at least one of the inlet nozzle assemblies is swingably mounted in the nozzle body in relation to a longitudinal center axis of the nozzle body.

22. The device of claim 21, wherein the at least one of the inlet nozzle assemblies is swingably mounted for movement about an angle of 0° to +/−80° in relation to the longitudinal center axis.

23. The device of claim 1, wherein an odd number of inlet nozzle assemblies and outlet nozzle assemblies is provided.

24. The device of claim 23, wherein the number is three, five or seven.

* * * * *